United States Patent [19]

Griffiths

[11] Patent Number: 4,723,117

[45] Date of Patent: Feb. 2, 1988

[54] FUSE ASSEMBLY

[75] Inventor: Thomas W. Griffiths, Lexington, Ohio

[73] Assignee: Hubbell Incorporated, Orange, Conn.

[21] Appl. No.: 26,262

[22] Filed: Mar. 16, 1987

[51] Int. Cl.[4] ..... H01H 85/02

[52] U.S. Cl. ..... 337/186; 337/158

[58] Field of Search ..... 337/158, 186, 187, 188, 337/206, 208, 209, 227, 228, 235, 248, 252, 213; 174/138 F, 525; 439/621, 622; 220/327

[56] References Cited

U.S. PATENT DOCUMENTS 2,454,962 11/1948 Brown ..... 220/327

3,280,280 10/1966 Gryctko ..... 337/158

*Primary Examiner*—H. Broome

*Attorney, Agent, or Firm*—Jerry M. Presson; Walter C. Farley

[57] ABSTRACT

A fuse assembly includes a housing having a base, side and end walls and a removable cover. Studs extend through the base and a current limiting fuse is connected between the studs. The cover, which has an edge gasket, is held against the side and end walls by fasteners which extend through the cover and threadedly engage the studs, the fasteners having enlarged heads to press against the outer surface of the cover and hold it firmly in place, forming a sealed interior chamber for the fuse. A locking filament inhibits unscrewing the fasteners.

4 Claims, 4 Drawing Figures

FUSE ASSEMBLY

This invention relates to an improved fuse assembly, particularly for use in a subway or other transit system car, and to a technique for modifying an existing fuse to incorporate the improvements.

BACKGROUND OF THE INVENTION

Many electric rail transit system cars in existence today are provided with fuse assemblies which are constructed as part of the wheel and drive assemblies. These fuse assemblies, which may be rated at, e.g., 700 amperes, have an elongated housing commonly made of plastic with a simple ribbon fuse connected between electrical terminals at opposite ends thereof. The housing has a base which is secured to part of the current collector or vehicle structure but it has no cover. The fuse element is thus exposed to the outside and, of course, to whatever dirt or weather conditions might exist.

The housing also usually has elements of a magnetic field shaping device at opposite sides of the middle of the housing, on either side of a narrowed portion of the ribbon fuse element, to help quench any arc which might develop at that location.

Because of the heat and arcs, etc. which can be developed in a fuse of this type, it is not practical to put a cover on the housing. Accordingly, it is simply left open and presents a potential shock hazard as well, even though it is normally mounted on the "third rail" side of the train car and is therefore accessible only to trained maintenance personnel who should know enough to keep away from the fuse. A further hazard is thermal and mechanical damage to the vehicle from unlimited currents passed by a ribbon fuse.

Another reason for leaving the housing open is so that the condition of the fuse element can be visually checked. A glance is all that is necessary to see if the element has blown.

SUMMARY OF THE INVENTION

An object of the present invention is to provide an improved fuse and housing for a transit car.

A further object is to provide components usable to modify an existing fuse and housing structure so that the result is a fuse contained within a closed housing.

Yet another object is to provide a technique for modifying an existing fuse structure so that it incorporates a current limiting fuse.

Briefly described, the invention includes a fuse assembly comprising a housing made of an electrical insulating material having a generally flat base, side and end walls extending generally perpendicular to the base, the distal edges of the walls defining an opening through which the interior of the housing is accessible. A cover is shaped and dimensioned to close the housing opening, the cover being made of an electrical insulating material at least part of which is transparent, the cover having first and second openings therethrough. First and second electrically conducted studs extend through the base, each stud having inner and outer ends, the outer ends being adapted for connection of electrical conductors thereto and the inner ends being externally threaded. A current limiting fuse extends between the inner ends of the studs, the fuse having a casing, conductive end members on the casing connected to the studs, a fusible element connected between the end members, and particulate material within the casing surrounding the fusible element. First and second nuts hold the fuse on the studs. First and second fasteners extend through the first and second openings in the cover, each fastener having an internally threaded recess at one end for threadedly engaging one of the studs and an enlarged portion for engaging the outer surface of the cover to retain the cover against the distal edges of the walls.

BRIEF DESCRIPTION OF THE DRAWINGS

In order to impart full understanding of the manner in which these and other objectives are attained in accordance with the invention, particularly advantageous embodiments thereof will be described with reference to the accompanying drawings, which form a part of this specification, and wherein.

DESCRIPTION OF THE PREFERRED EMBODIMENT

Figure 1:
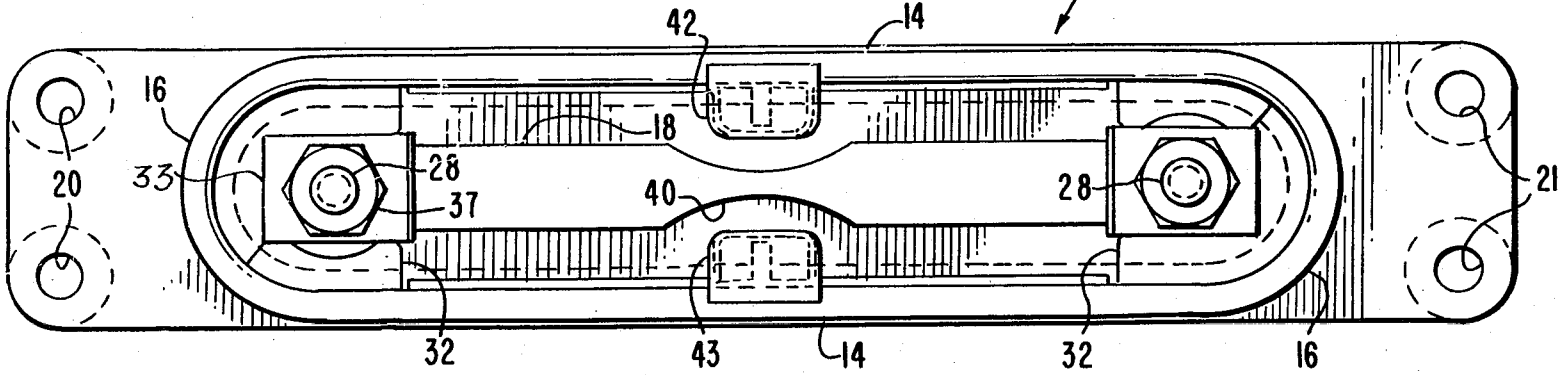
FIG. 1. PRIOR ART
FIG. 1 is a top plan view of a prior art fuse assembly which can be modified to form the fuse assembly of the present invention.
Figure 2:
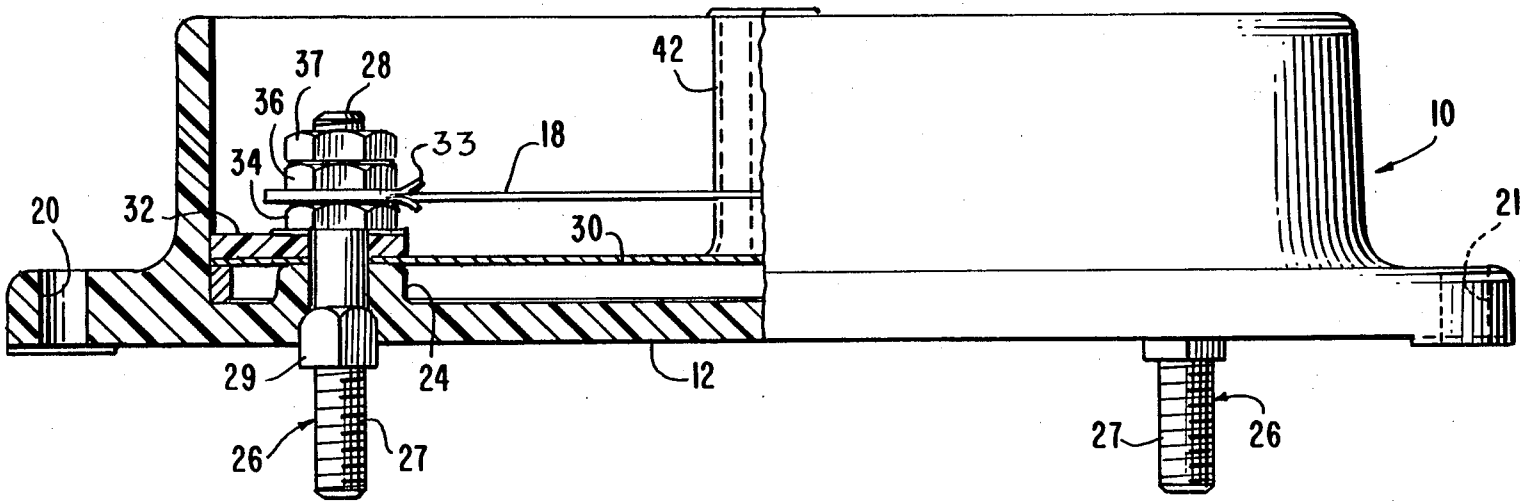
FIG. 2. PRIOR ART
FIG. 2 is a side elevation, in partial section, of the assembly of FIG. 1.

It will be recognized from the following discussion that an apparatus in accordance with the invention can be constructed "from scratch" following the design constraints discussed herein. However, a particular purpose of the invention is to provide a technique for modifying existing fuse assemblies so that they satisfy the criteria of the invention. Accordingly, the structure will be discussed in the context of the modification approach beginning with a brief description of the prior art device which is illustrated in FIGS. 1 and 2.

As seen therein, the fuse assembly includes a housing indicated generally at 10 which has a generally flat base plate 12 and upstanding, generally perpendicular side walls 14 and end walls 16. The side walls are significantly longer than the end walls and the end walls are curved to form smooth transitions with the side walls so that, together with the base 12, the walls define an elongated interior volume to receive a fusible element 18. The base 12 has end portions which are provided with openings 20 and 21 to receive mounting bolts or the like.

Base plate 12 is provided on its inner surface with upstanding bosses 24 which are penetrated by studs 26. Each stud has an externally threaded outer end 27, an externally threaded inner end 28 and a non-circular portion 29 which is partially received in a non-circular recess in the base concentric with boss 24.

Inside the housing is provided a liner 30 which is an arc-resisting liner made of a glass polyester or the like. This liner is provided to protect the interior of housing 10, which is made of a plastic or polymeric material, from the possibly damaging effects of arcs occurring as the result of excessive current causing the fusible element to melt. Liner 30 has a hole through which stud 26 extends at each end and is held in place by a high-impact, molded plastic retainer lug 32 clamped in place by nut 34.

Each end of fusible element 18 is held in a retainer clip 33 and is clamped against nut 34 by jam nuts 36 and 37.

As best seen in FIG. 1, the central portion of fusible element 18 is narrowed to define a region 40 which will melt under conditions of excessive current above the level for which the fuse is designed. Under many conditions, arcing will occur after this central portion has melted because of the high currents involved. Accordingly, magnetic field shaping elements 42 and 43 are mounted on the side walls 14 adjacent region 40 to assist in driving the arc into the box and quenching it. Liner 30 also covers these field shaping elements.

As previously indicated, the housing is open to the outside and must be left open, when designed as shown in FIGS. 1 and 2, because of the heat involved and for other reasons.

Figure 3:
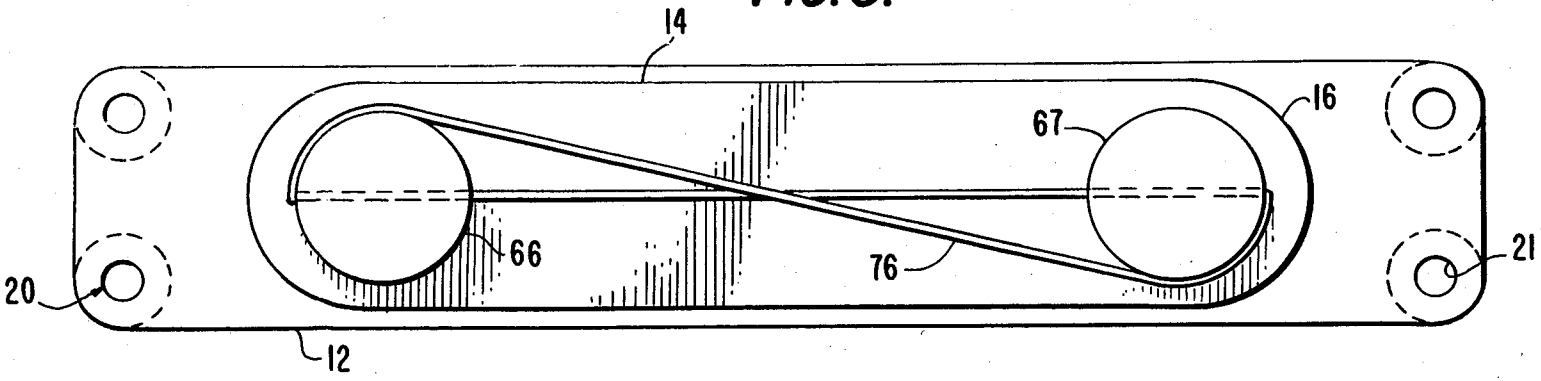
FIG. 3 is a top plan view of a fuse assembly in accordance with the invention.
Figure 4:
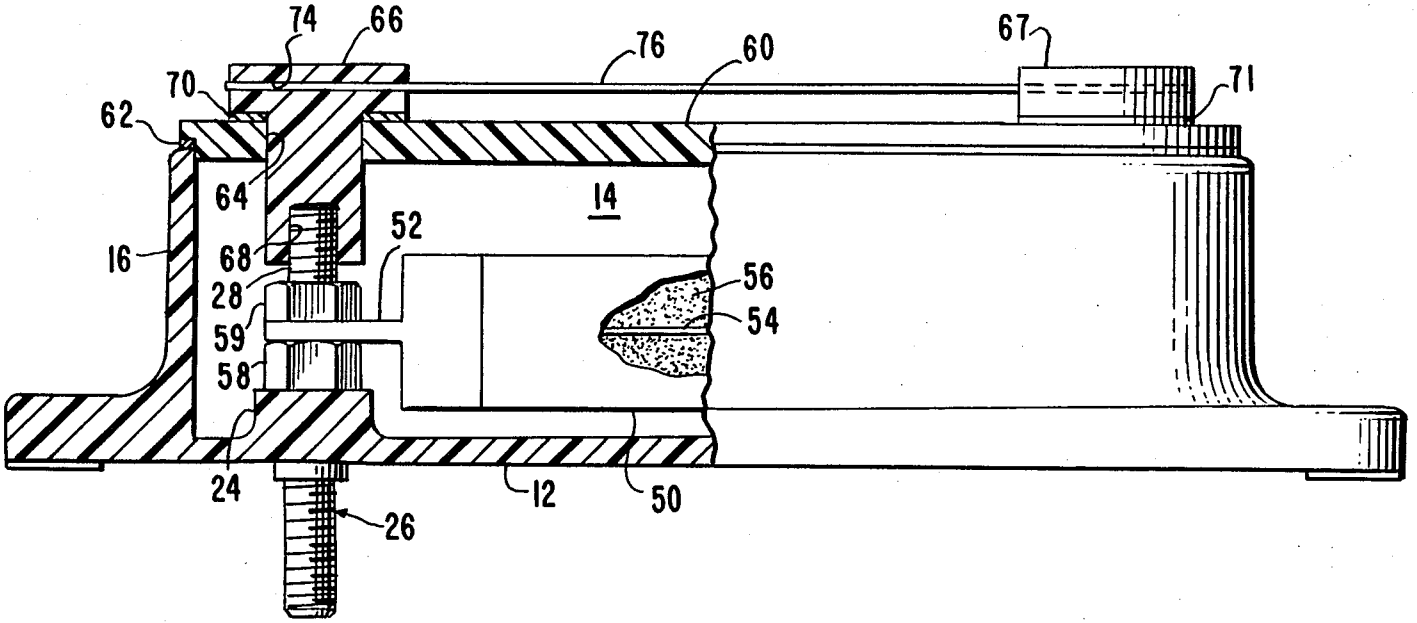
FIG. 4 is a side elevation, in partial section, of the assembly of FIG. 3.

An apparatus in accordance with the present invention is shown in FIGS. 3 and 4 in which it will be seen that the housing is fundamentally unchanged and has a base portion 12, side and end walls 14 and 16 and mounting holes 20 and 21 at opposite ends. The base is also provided with bosses 24 having openings therethrough to receive studs 26 which have internal and external threaded ends. However, the structure is otherwise quite different.

A significant change is the replacement of fusible element 18 with a current limiting fuse 50 as illustrated in FIG. 4. The current limiting fuse, itself, is a commercially available article manufactured by several different companies. It includes an electrically nonconductive tubular casing, which can be circular or square in cross section, with conductive end members 52 which are electrically conductive and which are provided with openings through which threaded portions 28 of studs 26 extend. Between the conductive end portions is at least one fusible element 54, partly seen in FIG. 4, which is surrounded by sand or other particulate or stone material 56. Commonly, a plurality of fusible elements are connected in parallel within the casing. The fusible elements, which can be silver, are also provided with a controlled current level at which a portion can melt in the event of current exceeding that predetermined level. When the element melts, the arc is confined in the sand, squeezed and cooled so that the arc itself actually provides a back-voltage, reducing the level of current flow in the circuit with which the fuse is associated. Current limiting fuses are available with or without visible "pop-up" indicators which show the "good" or "blown" status of the fuse.

Each end 52 of fuse 50 is clamped between a retaining nut 58 and a clamping nut 59.

It will be observed that liner 30 has been eliminated from the structure along with retainer lug 32 and also elements 42 and 43 since the magnetic field shaping device has no further function and the arc-resisting liner is unnecessary.

The housing is provided with a cover 60 which is preferably made of a transparent electrically insulating polymeric material which allows the condition of the fuse indicator to be visually observed. If a fuse having no indicator is used, the cover need not be transparent, but a meter must then be used to check the fuse status which is much slower. The cover is shaped to generally conform to the distal edges of walls 14 and 16 and is provided, around its edge, with a recess which receives a gasket 62. Cover 60 is also provided with openings 64 near opposite ends of the cover, these openings having their central axes aligned with the axes of studs 26. Fasteners 66 and 67 extend through these openings, each fastener having an internally threaded recess 68 at the inner end thereof for threaded engagement with the inner distal end of its associated stud 26. Preferably, fasteners 66 and 67 are made of an electrical insulating material. The outer portion of each fastener 66, 67 is enlarged to form a head which presses against the outer surface of cover 60 to retain the cover and its gasket 62 in firm engagement with the edge of walls 14,16. Additional gaskets 70,71 fit between the enlarged heads and the outer surface of the cover to seal openings 64. The sealing action provided by gaskets 62, 70 and 71 is quite important because it is necessary for a current limiting fuse of the type illustrated to be kept dry. If water is permitted to saturate the sand 56, heat generated within the fuse can cause it to explode. It is therefore important that the interior of the housing be kept dry.

As a safety lock, each enlarged head of fasteners 66 and 67 is provided with a diametrically extending opening which is perpendicular to the central axis of its internally threaded recess 68. When the installation is completed, a polymer safety lock in the form of a strand of polymeric material 76 such as nylon or the like is threaded through the two openings 74 and the ends thereof are welded or otherwise joined together so that an endless strand, arranged as shown in FIG. 3, is formed. It will be observed that the strand is wrapped so as to preclude the possibility of loosening fastener 66 and 67 together.

As will be recognized, the components formed and assembled as described create a substantially improved fuse assembly with minimum modification, working from the existing apparatus, and using that apparatus to its greatest advantage.

While one advantageous embodiment has been chosen to illustrate the invention, it will be understood by those skilled in the art that various changes and modifications can be made therein without departing from the scope of the invention as defined in the appended claims.

What is claimed is:

1. A fuse assembly comprising a housing of electrical insulating material having a generally flat base, side and end walls extending generally perpendicular to said base, the distal edges of said wall defining an opening through which the interior of said housing is accessible;

a cover shaped and dimensioned to close said housing opening, said cover being made of an electrical insulating material, said cover having first and second openings therethrough;

first and second electrically conductive studs extending through said base, each said stud having inner and outer ends, said outer ends being adapted for connection of electrical conductors thereto and said inner ends being externally threaded;

a current limiting fuse extending between said inner ends of said studs, said fuse having conductive end members connected to said studs, a fusible element connected between said end members, a casing and particulate material within said casing surrounding said fusible element;

first and second nut means for holding said fuse on said studs; and first and second fasteners extending through said first and second openings in said cover, each said fastener having an internally threaded recess at one end for threadedly engaging one of said studs and an enlarged portion for engaging the outer surface of the cover and for retaining said cover against the distal edges of said walls.

2. An assembly according to claim 1 and further comprising a first gasket between said cover and said edges of said walls for sealingly closing the interior of said housing;

second and third gaskets between said enlarged portions of said first and second fasteners, respectively, and said cover for sealingly closing said openings through said cover.

3. An assembly according to claim 2 wherein at least a portion of said cover is transparent, said assembly further comprising a hole extending completely through said enlarged portion of each of said fasteners perpendicular to the rotational axis of said internally threaded recess at the end thereof; and an elongated strand of polymeric material extendable through said holes in opposite directions and joinable to form an endless polymeric safety lock.

4. A method of modifying a fuse assembly of the type having a housing of electrical insulating material having a generally flat base and side and end walls extending generally perpendicular to said base and defining an opening, first and second electrically conductive studs extending through said base and having inner and outer ends, at least the inner ends thereof being externally threaded, a bare fuse element extending between said inner ends of said studs and nut means for securing said element to said studs, comprising the steps of removing said bare fuse element from said studs;

installing a current limiting fuse on said studs, said current limiting fuse having a casing, electrically conductive end members attachable to said studs, a fusible wire extending between said end members and particulate material substantially filling said casing and surrounding said fusible wire;

providing a substantially flat cover having an edge configuration generally matching the shape of the distal edges of said side and end walls, said cover having two openings therethrough aligned with said studs;

placing said cover on said distal edges with a gasket between said edges and said cover;

providing two fasteners each having an enlarged head and an internally threaded recess at the other end from said head, the threads therein being engageable with the threads on one of said studs;

inserting said fasteners through said openings in said cover with a gasket between each said head and said cover and threading said fasteners onto said studs; and locking said fasteners against unthreading rotation.

* * * * *